US005225255A

United States Patent [19]

Kaulfuss et al.

[11] Patent Number: 5,225,255

[45] Date of Patent: Jul. 6, 1993

[54] BIRD ORNAMENT

[75] Inventors: William P. Kaulfuss, Wilmette; Robert H. Kaulfuss, Northbrook, both of Ill.

[73] Assignee: Kaulfuss Designers, Inc., Chicago, Ill.

[21] Appl. No.: 675,404

[22] Filed: Mar. 26, 1991

[51] Int. Cl.[5] ..... A63H 3/16; A63H 33/16

[52] U.S. Cl. ..... 428/16; 428/542.8; 446/388

[58] Field of Search ..... 40/417, 539; 428/16, 428/7, 542.8; 446/388

[56] References Cited

U.S. PATENT DOCUMENTS

| | | | |
|---|---|---|---|
| 2,237,897 | 4/1941 | Vos | 428/16 X |
| 2,256,584 | 9/1941 | Steeple | 428/16 X |
| 3,419,995 | 1/1969 | Siegler | 40/417 X |
| 4,239,825 | 12/1980 | Kaulfuss et al. | 428/16 |
| 4,425,388 | 1/1984 | Oppenheimer, Jr. | 428/8 X |

*Primary Examiner*—Henry F. Epstein
*Attorney, Agent, or Firm*—Walter C. Ramm

[57] ABSTRACT

Ornamental bird devices, each comprising a first blank to simulate or be representative of head and body of a bird, and a second blank to simulate or be representative of wings for the head and body of the bird of the first blank. The blanks are of thin, flexile, foldable, creasable and resilient stock. Each blank defines a plurality of indents, and a first blank and a matched second blank are adapted to be assembled in mutual engagement with each indent of the one in hooking relationship with a corresponding indent of the other. An assembled device may comprise, for example, a mobile. Blanks for one or for several devices may be presented on one sheet of stock, and, so presented, each blank is readily and selectively hand-removable from the sheet.

4 Claims, 2 Drawing Sheets

Fig. 1
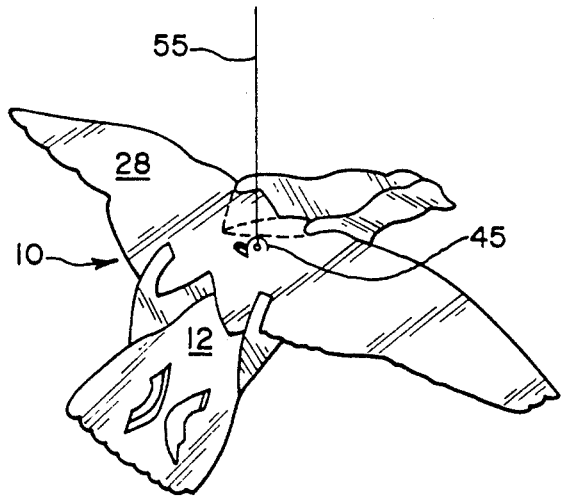
Fig. 2
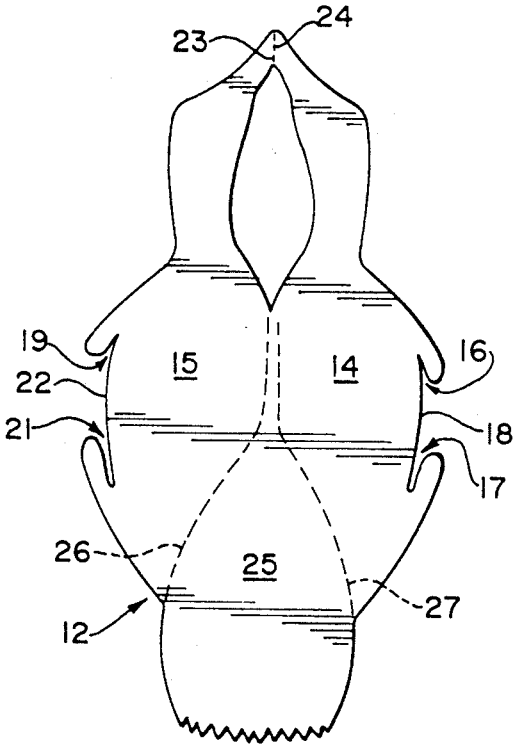
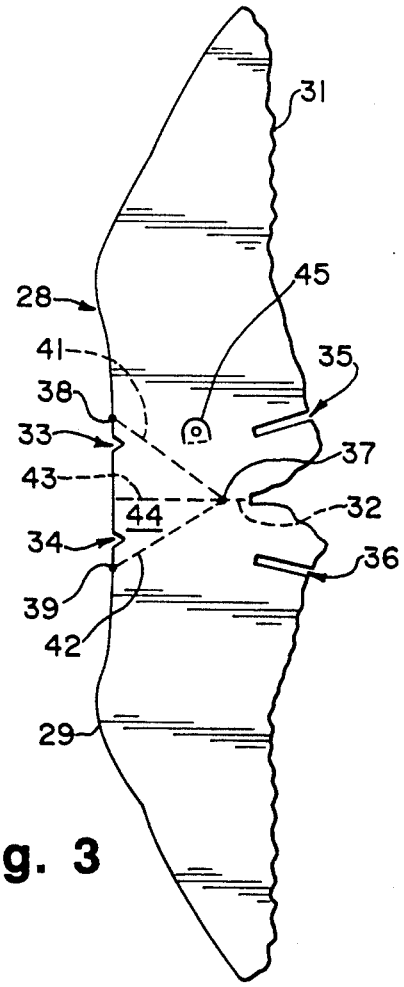
Fig. 3

BIRD ORNAMENT

BACKGROUND OF THE INVENTION

1. Field of the Invention

This invention is in the field of ornamental and instructional devices for decorative, educational and business-promotional purposes, and relates to two-member devices or figures originating in the planar piece and with resilient and inter-connecting elements.

2. Description of Related Art

The art related to this invention includes the disclosures of these U.S. Pat. No. 3,419,995, Hand Operated Toy, discloses a paper toy simulating a bird with members which are movable relative to each other. U.S. Pat. No. 4,239,825, Bird Ornament, discloses a unitary bird ornament with locking tabs to hold the ornament in assembled configuration. U.S. Pat. No. 4,425,388, Adjustable Flight Simulating Mobile Device, discloses wind-responsive bird mobile suspended on four lines and whereof a planar body member defines a linear aperture for receiving the wing member.

SUMMARY OF THE INVENTION

The objects of this invention include, first, to provide a simple and inexpensive manually-assembled device simulating a bird on a range of scales from small to—depending on specie—larger than life-size; second, to impart realistic appearance to the device, thus adapting it—for example, as a mobile—for various applications, such as instructional, commercial, entertainment and ecology-related purposes; and, third, to afford children and others worthwhile opportunities to accomplish instructive assemblage of the device and, additionally, enjoyable display of the assembled device.

In summary, this invention fulfills the said objects by a device comprising a first piece or blank simulating the head and body of a particular bird, and a second piece or blank simulating said bird's wings, and whereof the blanks are adapted mutually to engage. In this summary, and throughout this specification, the word "edge" means and includes, with reference to a part of a blank described as an edge, the edge-portion of the blank adjacent or along the said edge; and, the word "indent" means or refers to a slit, a slot, a notch, a cut or a similar indentation in or proximate an edge. The first blank has right and left sides which, across at least one connective portion, are generally opposable. Each side has a free edge which defines a forward indent, a rearward indent, and an arcuate edge intermediate those first-blank indents. Each connective portion is frontal or ventral of the first blank.

The second blank defines leading and trailing edges, a front-to-back axis, an axial point, right and left leading-edge indents, and right and left trailing-edge indents. Each second-blank indent, in the assembled device, positionally corresponds with a first-blank indent. The second blank also has an angle flap including the axial point.

Assembly of the device is accomplished by folding the sides of the first blank upwardly and inwardly until they become generally opposed and their arcuate edges are upward; joining the trailing edge to the first blank by means of a trailing-edge indent hooked in each rearward indent; and, joining the leading edge to the first blank by means of a leading-edge indent hooked in each forward indent. The angle flap may be flexed in aid of these joining and hooking operations.

The blanks and their indents are sized, shaped and spaced so that, in the assembled device, the second blank has front-to-back curvature near the first blank, the arcuate edges contribute to and tend to assure said curvature, and the resilient character of the blanks tends to re-enforce their engagement.

The device may originate in a larger piece of generally planar and suitably flexile and resilient stock from which the blanks may be readily separated. Blanks for several devices may be peripherally-defined on one sheet of stock.

BRIEF DESCRIPTION OF THE DRAWINGS

In the drawings:

FIG. 1 is a toward-the-rear perspective view of an ornamental bird device in assembled configuration and suspended by a line.

FIG. 2 is a first blank for the device of FIG. 1.

FIG. 3 is a second blank for the device of FIG. 1.

DESCRIPTION OF THE PREFERRED EMBODIMENT

Figure 4:
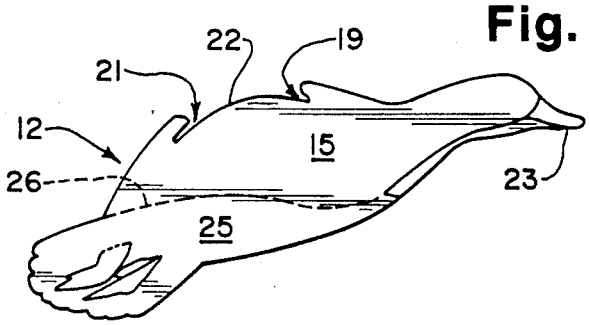
FIGS. 4 through 6 are sketches illustrating the assembly of devices such as the device of FIG. 1.

The drawings show a preferred embodiment of the ornamental bird device of this invention. In the drawings reference numerals identify elements, parts, aspects and presentations of the device, as follows: 10 is the device; 12 is the first (body-head) blank of device 10; 14 and 15 are first and second sides of blank 12; as to side 14, 16 shows a first indent, 17 shows a second indent and 18 is a first arcuate edge; as to side 15, 19 shows a third indent, 21 shows a fourth indent and 22 is a second arcuate edge; also, on blank 12, 23 is a first connective portion, 24 is a first (head) crease line crossing and defining portion 23, 25 is a second connective portion, and 26 and 27 are second and third (body) crease lines bounding portion 25; 28 is the second (wings) blank of device 10; and, as to blank 28, 29 is the leading edge, 31 is the trailing edge, 32 indicates the front-to-back axis, 33 shows a fifth indent, 34 shows a sixth indent, 35 shows a seventh indent, 36 shows an eighth indent, 37 is a first point on axis 32, 38 and 39 are second and third points on edge 29, 41 is a first (shoulder) crease line, 42 is a second (shoulder) crease line; 43 is a fourth (axial) crease line, 44 is an angle flap and 45 is a hang tab.

Also, 50 is a sheet of stock; 51 is a demarcation of the outer peripheral outline and 52 is inner peripheral outline for blank 12 on sheet 50; 53 is an interior waste portion as defined by outline 52; 54 is a demarcation of the peripheral outline of blank 28; and, 55 is a line for suspending device 10.

The preferred embodiment is further described from two standpoints—where several each of blanks 12 and 28 are a presentation in and yet unremoved from the context of a larger sheet lay-out, and where matched blanks, apart from the larger sheet, become and be engaged to comprise a device 10. From both standpoints, of course, the blanks require, and they are formed of and from, a suitable material or stock. Typically, the stock is planar or sheet-like in origin, as a single thin ply, is adapted to be die-cut, perforable, scored, or easily cut by scissors, and is also suitably foldable, creasable, stiff, flexile and resilient, and the blanks are of the same stock. Thicker construction papers, cardboard, tag board and similar papers or paper-like materials are usually acceptable; specifically, the widely-available "Springhill" brand of 150 lb. tag board is well suited for the blanks of the preferred embodiment.

Figure 7:
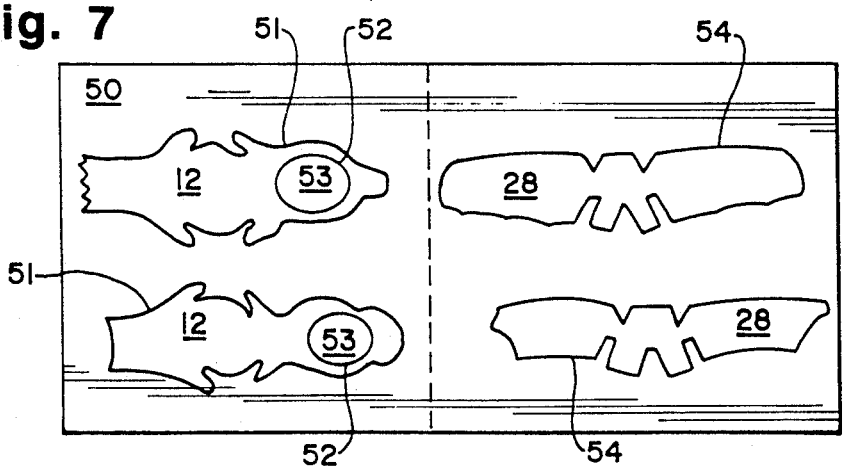
FIG. 7 is a plan view of sheet stock showing the lay out of several first and second blanks thereon, for ornamental bird devices, as supplied.

From the first standpoint, FIG. 7 illustrates that blanks for a number of devices 10 may be advantageously presented on a single sheet 50. On the sheet, each blank 12 is peripherally defined by a line 51, and, within a line 51, inner line 52 outlines portion 53 and completes the definition of the blank. Each blank 28, as to be matched with a particular blank 12, is peripherally defined by line 54. Each blank is a unitary element or member, and is made readily and selectively hand-separable, from and out of sheet 50, by conventional means such as die-cuts along lines 51, 52 and 54.

From the second standpoint, and out of sheet 50, two matched blanks—one a blank 12 and the other a blank 28—are adapted to become and be an assemblage wherein they are mutually engaged and whereby front-to-back curvature is imparted and, as appropriate, dihedral may also be imparted, to blank 28. FIG. 2 shows blank 12—representative of a bird's body and head—with opposable sides 14 and 15, and portions 23 and 25 joining the sides. Side 14 has a free edge including and defining forwardly-oriented indent 16, rearwardly-oriented indent 17, and edge 18 between indents 16 and 17, and side 15 has and defines the similar forward indent 19, rearward indent 21 and edge 22 therebetween. Line 24 is intermediate sides 14 and 15, and effectively locates portion 23. Line 26, along side 14, and line 27, along side 15, are boundaries of portion 25.

FIG. 3 shows blank 28—representative of wings—with edges 29 and 31, axis 32 intermediate said edges, point 37, flap 44 and tab 45. Edge 29 defines leading-edge indents 33 and 34 on opposite sides of the axis, point 38 proximate and outboard of indent 33, and point 39 proximate and outboard of indent 34. Blank 29 is substantially symmetric as to the axis and has first (right) and second (left) wing-portions. Flap 44 is triangular; line 41, which runs between points 37 and 38, and line 42, which runs between points 37 and 39, as well as edge 29, between points 38 and 39, demark the flap. Die-cut tab 45 deploys upwardly. Edge 31 defines trailing-edge indents 35 and 36 on opposite sides of the axis.

Figure 5:
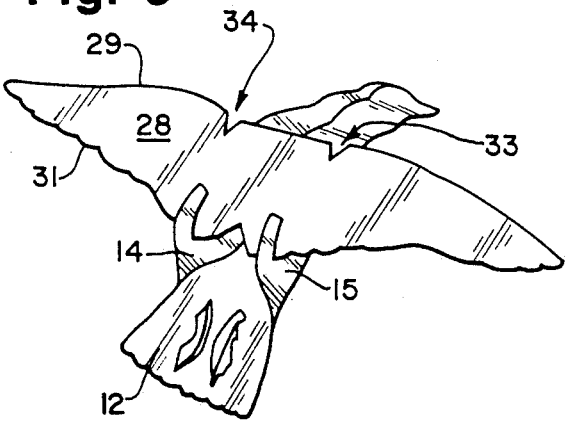
Figure 6:
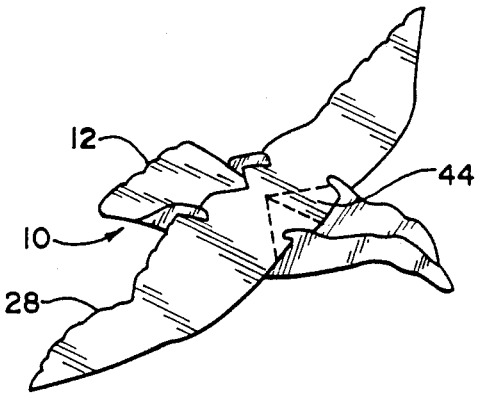

Assembly of a device 10 from individual matched blanks 12 and 28 may be accomplished these three steps: First, blank 12 is prepared by folding sides 14 and 15, along lines 23, 26 and 27, upwardly and inwardly, toward parallelism, and so that they are generally opposed and edges 18 and 22 are upwardly disposed, as in FIG. 4. Second, trailing-edge indents 35 and 36 are inserted respectively into rearward indents 17 and 21, as in FIG. 5, to create manually hooking relationships between blank 12 and edge 31. Third, with blank 28 flexed lightly front-to-back and, as and if necessary, flap 44 creased slightly and flexed inwardly along line 43, leading-edge indents 33 and 34 are inserted respectively into forward indents 16 and 19, as in FIG. 6, to create mutual hooking relationships between blank 12 and edge 29, and to complete engagement between the blanks. Flap 44, as adapted to flex inwardly, enhances the ease and effectiveness of the said third step. As inserted, the respective pairs of indents extend maximally into each other. In the engagement, the respective blanks touch or bear upon each other at or proximate said indents, and blanks 38 is seated onto or proximate edges 18 and 22 with said edges there conferring or tending to assure a front-to-back curvature for blank 28. Reasonable care should be taken to avoid tearing or deforming the blanks during assembly.

Blanks 12 and 28, relative to each other, are sized and shaped, and the respective hooking pairs of indents thereof—that is, first indent 16 and fifth indent 33, second indent 17 and seventh indent 35, third indent 19 and sixth indent 34, and fourth indent 21 and eighth indent 36—are sized and spaced to enable engagement and, in the engagement, to take advantage of the resilience of the tag board or other stock of which the blanks are formed.

The stock's resilient character is meant to contribute to or re-enforce the assembled condition and configuration of device 10. Indeed, joined blanks 12 and 28 are in mutual resilient or resilience-augmented engagement because their tendencies resiliently to counter or react against structural constraints, as imposed by the hooking relationships between said pairs of indents and/or the curvature concomitantly imparted by edges 18 and 22, strengthen the device and enable its characteristic form. Absent those constraints, sides 14 and 15 would tend to unfold outwardly, and blank 28 likewise would resume a planar character.

According to the sizes and shapes of blanks 12 and 28, and the spacings of the indents, blank 28 in device 10 may display a realistic and attractive dihedral angle. For this purpose, the relative effective spacings of indents 16 and 19 in the FIG. 1 device is less than the spacing between indents 33 and 34 in FIG. 3, blank 28 has a slight inward axial fold, and edge 29 between indents 33 and 34 describes a very shallow "V". And, as each wing-portion extends outwardly of the axis, it also inclines upwardly, at least proximate axis 32, as in FIG. 1.

Suspended on line 55 joined to deployed tab 45, the device 10 of FIG. 7 comprises a mobile.

In one exemplary preferred embodiment, five blanks 12 and five blanks 28, to provide five devices 10 in accordance with this invention, are die-cut on a single sheet 50 of 150 lb. tag board, and form a collective presentation. The five devices respectively simulate a wood duck, a mallard, a Canada goose, a loon and a canvasback. The sheet is rectangular with approximate dimensions of 10½ inches by 30 inches, and it is folded and received in an envelope on which assembly instructions appear.

The said exemplary canvasback device—wherefor the blank 12 is shown in FIG. 2 and the blank 28 is shown in FIG. 3—has approximate dimensions and other exemplary characteristics, as follows: Said blank 12 has overall length of 7 inches and maximum width (at points near indents 17 and 21) of 3¼ inches; indents 16 and 19 are cut as essentially angular notches, each with a depth of ½-inch; indents 17 and 21 are cut as slightly curved slits (reflecting the arcuate character of edges 18 and 22), each with a depth of ⅝-inch; and, edges 18 and 22 each have length of 1¾ inches. Said blank 28 has wingspan of 10 inches and an edge-to-edge axial dimension of 1⅝ inches; lines 41 and 42 are each 1½ inches in length and meet (at point 37) at an angle of approximately 80°, point 37 is 1 inch rearward of edge 29, indents 34 and 35 are notches, each with a depth of ½-inch and spaced ⅝-inch from axis 32, and indents 35 and 36 are slots, each with a depth of ⅝-inch, spaced about 1 inch from axis 32, and slightly angled so that the forward end of the slot is closer to the axis. The blanks may be printed on both surfaces with colored and anatomically accurate depictions of a canvasback duck, and connective portion 25 is die-cut to provide simulated legs and feet as appear in FIGS. 4 and 7.

Many other specific embodiments are within the spirit and scope of this invention.

What is claimed is:

1. An ornamental bird device, for manual assembly, comprising a first blank, representative of body and head, with opposable first and second sides joined by at least one connective portion, whereof the first side defines first and second indents, and a first arcuate edge between the first and second indents; and, the second side defines third and fourth indents, and a second arcuate edge between the third and fourth indents;

a second blank, representative of wings, with leading and trailing edges, a front-to-back axis intermediate the edges, an angle flap, and a first point on the axis; whereof the leading edge defines fifth and sixth indents respectively on opposite sides of the axis, a second point proximate the fifth indent, and a third point proximate the sixth indent; the trailing edge defines seventh and eighth indents respectively on opposite sides of the axis; the angle flap is demarked by first and second crease lines, the first crease line runs between the first and second points, and the second crease line runs between the first and third points;

whereof each blank is of a foldable, flexile and resilient paper-like stock;

so that, when the device is assembled, the first blank is folded proximate each connective portion; the sides are generally opposed; and, the blanks are mutually resiliently engaged with the arcuate edges proximate the second blank and, respectively, the fifth and the first indents, the sixth and the third indents, the seventh and the second indents, and the eighth and the fourth indents, in mutually hooking relationships.

2. The device of claim 1 where the blanks are of the same paper-like stock with foldable, flexile, resilient and creasable properties, the first blank has first and second connective portions, the first and third indents are forwardly disposed notches, the second and fourth indents are rearwardly (disclosed) disposed slits, the fifth and sixth indents are leading-edge notches, and seventh and eighth indents trailing-edge (slots) slits, the second points is outboard of the fifth indent, the third point is outboard of the sixth indent, and the second blank defines an axial crease line between the first point and the leading edge.

3. The device of claim 2 wherein the stock is tag board; the first connective portion is intermediate respective head portions of the sides; the second connective portion is intermediate respective body portions of the sides; each blank is defined by die-cuts in said stock; the device includes die-cut leg portions in the second connective portion a die-cut hang tab on the second blank proximate the axis; and, when the device is assembled, the angle flap is inwardly flexed.

4. A presentation comprising a sheet of thin foldable, flexile and resilient stock; and, demarcations on and within the edges of the sheet defining at least two first blanks and at least two second blanks according to claim 1 as to be separable from the sheet.

* * * * *